United States Patent [19]

Seireg et al.

[11] 4,037,084

[45] July 19, 1977

[54] DECOMPRESSION PLAN CALCULATOR

[75] Inventors: Ali A. Seireg, Madison, Wis.; Amr M. S. Baz, Cairo, Egypt

[73] Assignee: Wisconsin Alumni Research Foundation, Madison, Wis.

[21] Appl. No.: 665,174

[22] Filed: Mar. 9, 1976

[51] Int. Cl.[2] ..... G06C 27/00

[52] U.S. Cl. ..... 235/69; 235/124

[58] Field of Search ..... 235/69, 70, 85, 77, 235/78, 83, 84, 88, 124

[56] References Cited

U.S. PATENT DOCUMENTS

| | | | |
|---|---|---|---|
| 3,058,653 | 10/1962 | Des Granges | 235/88 R |
| 3,111,003 | 11/1963 | Droz | 235/88 R |
| 3,124,928 | 3/1964 | Brunet | 235/88 R |
| 3,681,585 | 8/1972 | Todd | 235/184 |
| 3,757,586 | 9/1973 | Borom | 73/432 R |
| 3,759,101 | 9/1973 | Borom et al. | 73/291 |
| 3,759,108 | 9/1973 | Borom et al. | 73/432 R |
| 3,759,109 | 9/1973 | Johnson et al. | 73/432 R |

*Primary Examiner*—Robert K. Schaefer
*Assistant Examiner*—Vit J. Miska
*Attorney, Agent, or Firm*—Theodore J. Long; John M. Winter; Harry C. Engstrom

[57] ABSTRACT

A decompression calculator for calculating safe and efficient diving schedules utilizing unequal time constants for uptake and elimination of inert gas in the diver's tissues. Scales are provided to calculate a safe decompression stop for a single stage decompression and the time of decompression required where the working depth, the initial depth and the bottom time are known. Decompression times for staged decompression dives may also be calculated.

6 Claims, 1 Drawing Figure

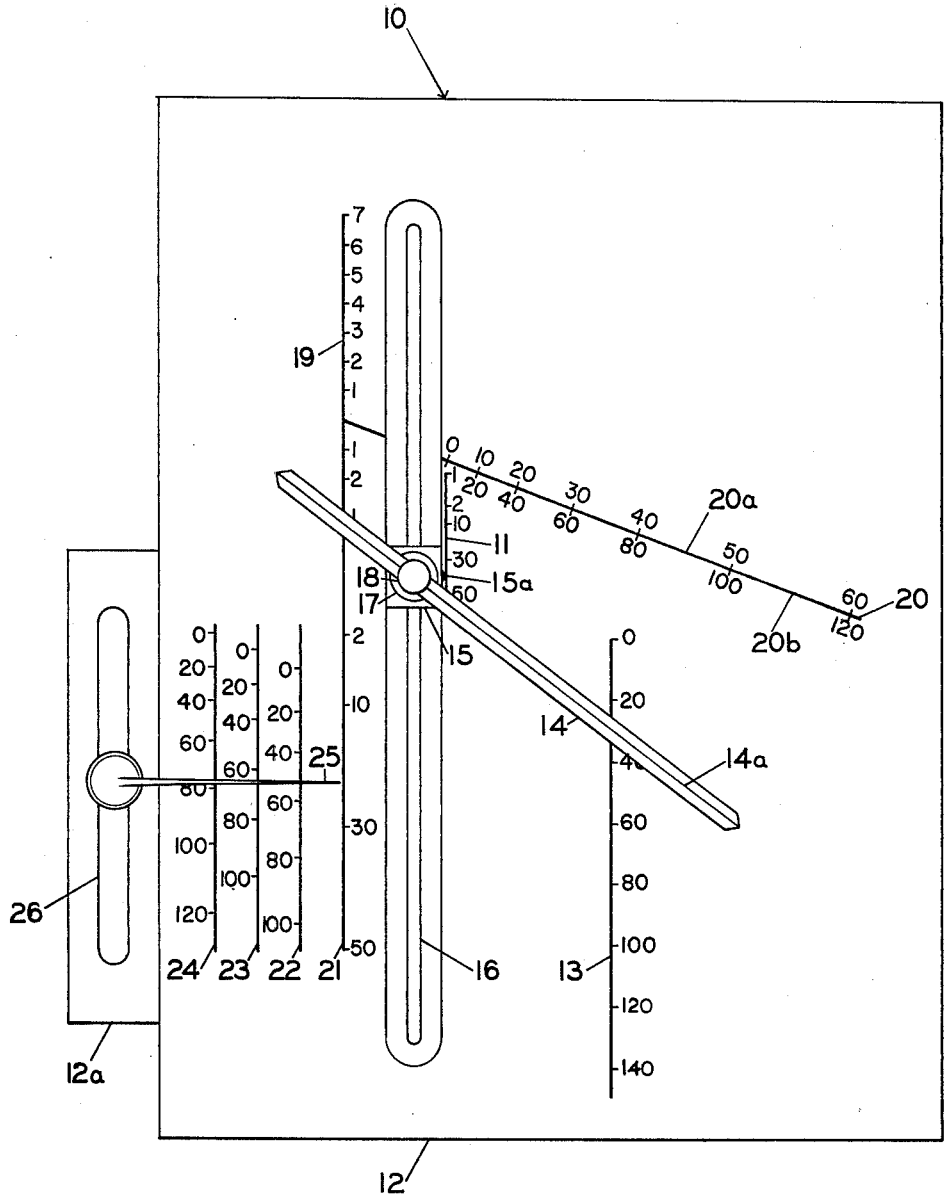
10
19
20a
20
20b
11
15a
18
17
15
14
14a
25
26
24
23
22
21
16
13
12a
12

DECOMPRESSION PLAN CALCULATOR

The Government has rights in this invention pursuant to grant number 04-3-158-5 awarded by the U.S. Department of Commerce.

BACKGROUND OF THE INVENTION

1. Field of the Invention

This invention pertains generally to methods and devices for calculating decompression schedules for underwater divers.

2. Description of the Prior Art

The problem of decompression sickness, or the "bends", is a well-known phenomena observed in divers who surface after spending substantial periods of time under water. Decompression sickness is caused by the so-called "inert" gas component of the diver's breathing mixture, such as nitrogen in a normal air mixture. As the diver descends, the pressure of the breathing mixture in the diver's lungs must necessarily be increased, and the inert gases in the breathing mixture tend to slowly absorb into the body fluids and tissues of the diver at a rate which depends in part upon the pressure of the breathing mixture. As the diver ascends, the inert gases absorbed by his fluids and tissues are released therefrom and are ultimately discharged from the diver's body through his lungs.

Although the physiological mechanism of decompression sickness is not completely understood, a too rapid release of the pressure on the diver's body will apparently cause the absorbed inert gases to form bubbles within the tissues of the diver which are of sufficient magnitude to cause damage to the body tissues. It has been observed, however, that rapid changes in pressure on the diver's body which do not exceed certain maximum pressure changes will not result in the onset of decompression sickness. It has been found that the ratio of the absolute pressure of the inert gases within the body tissue with respect to the ambient pressure on the body of the diver must not exceed a certain maximum ratio, generally called the supersaturation ratio, if decompression sickness is to be avoided. It has also been found that the supersaturation ratio varies as a function of the absolute tissue pressure.

Since the human body has many different types of tissues, it may be expected that the various tissues in the body would have different supersaturation ratios and different rates at which inert gases are absorbed and eliminated by the tissues. An early model of the actions of the body tissues was proposed by Boycott, Damant and Haldane, "The Prevention of Compressed--Air Illness," *J. Hygiene,* Vol. 8, pp. 342 et seq. (1908), which analogized the human body to a finite number of gas diffusion chambers pneumatically connected in parallel, with each chamber having a different supersaturation ratio and a different time constant of diffusion.

The decompression tables utilized by the United States Navy are substantially based on the theory introduced by Boycott et al. However, other models of the physiological behavior of body tissues under pressure have been developed, and various computational devices have been employed to simulate the body functions based on these models. Typically, such calculators have utilized several body tissue analogs having different time constants, as for example, a plurality of chambers wherein gas under pressure diffuses through a membrane in the compartments. Other calculators have been developed which utilize an electrical analog of such gas diffusion. It is apparent that with such multicompartment models it is necessary to continuously monitor all compartments to determine the highest pressure compartment in order to calculate a safe decompression stop. Such calculators have thus been complicated and are generally expensive.

Most decompression calculators such as those described above are based on physiological models which assume that the time constant of absorption and the time constant of elimination of gas from a tissue are the same. This is not a valid assumption, as demonstrated by H. V. Hempleman, "The Unequal Rates of Uptake and Elimination of Tissue Nitrogen Gas in Diving Procedures," *Medical Research Counsel,* R. N. Personnel Research Committee, U.P.S., pp. 195 et seq., (1960). The complexity required of the multiple compartment decompression plan calculators, or their electrical equivalents, also makes it virtually impossible to account for the differences in supersaturation ratio and tissue time constants which occur from individual to individual.

Various empirically derived tables have been developed by the Navies of the United States, Canada, and other countries. These tables were prepared by testing with subject divers to determine maximum rates of decompression without the onset of decompression sickness. While these tables are useful, they do not have sufficient data to plan dives which vary in time and depth from the dive plans used in preparing the tables. It may also be noted that the decompression tables of the various Navies do not agree uniformly. For example, the tables of the Canadian Navy prescribe a more conservative (longer duration) decompression schedule than do the U.S. Navy tables for dives of relatively short duration.

SUMMARY OF THE INVENTION

We have invented a compact calculator which allows quick and simple calculations of safe and efficient diving plans. We have determined that it is possible to approximate the many tissue time constants of a human being with a single time constant of uptake of inert gas and a single time constant of elimination, with the two time constants being substantially different. We have also determined that it is possible to approximate the continuous variation in the supersaturation ratio with discrete values of supersaturation ratio which are selected depending on the length of the dive at the working depth of the dive. We have further determined that by using these approximations, it is possible to calculate diving schedules which closely approximate the empirically derived diving tables, but which can also be used to calculate diving schedules which deviate substantially from the schedules given in the standard tables.

A diving plan calculator in accordance with our invention utilizes a plurality of scales marked off with spaced numerical markings on the surface of the calculator. These scales include a working depth scale, an initial depth scale, a difference scale, a decompression stop scale, an uptake time scale, and at least one decompression stop time scale. These scales are so related that by locating the working depth on the working depth scale, the initial depth on the initial depth scale, and the time at the working depth on the uptake time scale, it is possible to determine a safe decompression stop depth on the decompression stop scale by calculating means provided on the decompression calculator. Means are provided for relating a safe decompression stop depth to the decompression time required at that stop on the decompression stop time scales, with the decompression time scales being arranged such that each scale calculates the amount of decompression time required for a different supersaturation ratio. We have determined that a supersaturation ratio of 2.0 may be used to calculate a safe decompression stop and a safe decompression time for long duration dives of one hour or more. A supersaturation ratio of 2.2 may be safely used for calculating the decompression time for dives between 30 minutes and one hour, and a supersaturation ratio of 2.4 may be safely used for calculating the decompression time for dive times at the working depth of less than 30 minutes. These decompression stop time scales are utilized if it is possible to surface with only one decompression stop.

For staged compression dives, where more than one decompression stop is required, our decompression calculator has a elimination time scale with numerical markings thereon which is related to the other scales such that by locating a chosen second decompression stop on the decompression stop scale, and the first decompression stop on the working depth scale, means are provided to indicate on the elimination time scale the time required to be spent at the first decompression stop before the second stop can be safely reached. We have determined that the most satisfactory fit to the empirical diving tables of the various Navies using an air breathing mixture and under common dive conditions is obtained using an uptake time constant equal to 47 minutes, and an elimination time constant equal to 70 minutes. Other time constants may be used to provide more accurate results for non-air mixtures, for varying dive temperatures, and to accommodate differences between individuals.

Further objects, features and advantages of our invention will be apparent from the following detailed description taken in conjunction with the accompanying drawing showing a preferred embodiment of a decompression plan calculator exemplifying the principles of our invention.

BRIEF DESCRIPTION OF THE DRAWING

The drawing is a front view of the face of our decompression plan calculator.

DESCRIPTION OF THE PREFERRED EMBODIMENT

We have determined that it is possible to accurately and safety estimate the diving plan required by utilizing a single tissue model employing a first time constant for absorption of inert gas by the body tissue, and a second different time constant for the elimination of absorbed gases by the body tissue. The use of such an asymmetrical time constant, employed with the assumption of at least one discrete supersaturation ratio, allows diving plans to be calculated quickly as well as safely and accurately, and further provides for the adaptation of diving plans to different individuals, work loads and environmental temperatures. We have determined that proper selection of a discrete supersaturation ratio can be accomplished in accordance with the amount of time that the diver spends under water at the working depth, with these discrete supersaturation ratios allowing very satisfactory approximations to the actual diving parameters.

The method of calculating a diving plan in accordance with our invention may be summarized as follows. The dive parameters comprising uptake and elimination time constants, the supersaturation ratio required given the amount of time that the diver will spend at the working depth, and the working depth itself, are first determined. It is then possible to calculate the inert gas pressure in the diver's body tissue at the end of the dive at the working depth using these dive parameters. The working pressure on the diver's tissue will, of course, be proportional to depth of the dive. Thus, it is necessary to calculate the absolute inert gas pressure $P_{ei}$ in the diver's tissue at the end of a time period at the working depth pressure $P_w$ (corresponding to the working depth $d_w$). The foregoing literal numbers and others used herein are intended to represent general numerical values, as is customary. If the initial inert gas absolute pressure in the diver's tissue at the beginning of the dive is equal to a known pressure $P_i$, and $t_w$ is the time spent at the working depth, the pressure $P_{ei}$ in the diver's tissues may be calculated from the following equation:

$$P_{ei} = (P_i - P_w)\, e^{t_w/T_U} + P_w$$

The time constant $T_u$ is the time constant of uptake of the inert gas and is preferably determined in a manner which allows the closest fit of the results derived from the equation above to actual empirical data such as that obtained from Navy diving tables. We have determined that a satisfactory result for an air breathing mixture and for the average diver is obtained using an uptake time constant $T_u$ equal to 47 minutes. However, adjustment of the uptake time constant value (as well as the elimination time constant) may be made in order to obtain more accurate results for particular individuals, and for the conditions of the dive such as metabolic rate and temperature.

After the inert gas tissue pressure $P_{ei}$ at the end of the dive at depth $d_w$ has been calculated, it may be decided if it is safe for the diver to surface immediately, or if a decompression schedule must be calculated. This may be accomplished by dividing the tissue pressure $P_{ei}$ of the diver by the ambient pressure $P_o$ at the surface, and comparing the quotient with the appropriate supersaturation ratio S. If the quotient is less than the supersaturation ratio, the diver may return immediately to the surface without the need for decompression.

For the case where decompression is required, the ambient absolute pressure at the required first decompression stop may be calculated by dividing the tissue pressure $P_{ei}$ by the appropriate supersaturation ratio S to determine the ambient pressure $P_{s1}$ at the first safe decompression stop. Thus, the pressure $P_{s1}$ at the first decompression stop can be determined from the following equation:

$$P_{s1} = \frac{P_{ei}}{S} = \frac{(P_i - P_w)\, e^{-t_w/T_u}}{S} + \frac{P_w}{S}$$

Since the depth of the stop will be proportional to the pressure $P_{s1}$ at the decompression stop, (i.e. $P_{s1} = 0.43\, d_{s1} + P_o$) the depth of the stop may be calculated from the following equation:

$$d_{s1} = \frac{d_w}{S} + \frac{(P_i - P_o - 0.43\, d_w)}{0.43\, S}\, e^{-t_w/T_u} - \frac{K}{S}(S - 1)$$

where $d_w$ is the working depth in feet, $d_{s1}$ is the depth of the first decompression stop, $K = P_o/0.43$ and $P_o$ is the absolute pressure at the surface (14.7 psia at sea level). The constant $K$ is the depth in feet equivalent to the absolute atmospheric pressure at the surface.

We have determined that the constant variation of the supersaturation ratio S with dive time and dive pressure may be approximated by discrete values of supersaturation ratio, with the value of supersaturation ratio selected depending on the time spent at the working depth of the drive. A supersaturation ratio of 2.0 is generally accepted as a safe and conservative estimate, and it is commonly utilized in calculating decompression schedules. A supersaturation ratio of 2.0 is appropriate and safe for a longer duration dive of 1 to 2 hours or more, generally without regard to the depth of the dive. However, we have also determined that decompression times may be minimized safely by utilizing a second supersaturation ratio of approximately 2.2 for dives of 30 minutes to an hour, and a third supersaturation ratio of 2.4 for dives of 30 minutes or less, also generally without regard to the depth of the dive.

Safe diving schedules in accordance with our invention may be planned by calculating the first and any subsequent decompression stops using the conservative supersaturation ratio of 2.0, while the less conservative supersaturation ratios may be used to determine the amount of time that the diver must spend at the decompression stop. Using a constant supersaturation ratio of 2.0, the equation for the decompression stop becomes:

$$d_{sl} = \frac{d_w}{2} + \frac{1}{0.86}(P_i - P_0 - 0.43\, d_w)\, e^{-t_w/T_u} - \frac{K}{2}$$

where $K = 34.2$ feet for dives from sea level. Where $P_i$ is given in terms of an equivalent depth $d_i$, and assuming a dive from sea level, this equation becomes $$d_{sl} = \frac{d_w}{2} + \frac{1}{2}(d_i - d_w)\, e^{-t_w/T_u} - 17.09.$$

After the decompression stop is known, the time $t_1$ that the diver is required to remain at the decompression stop in order to lower his tissue pressure to a desired pressure $P_t$ may be calculated from the following equation:

$$t_1 = -T_e \ln\left[\frac{P_t - P_{sl}}{P_{ei} - P_{sl}}\right]$$

where *ln* is the logarithm to the base *e*. The time constant $T_e$ of elimination of inert gas from body tissues is not identical to the time constant $T_u$ of uptake of the inert gas, but is, in fact, sabstantially different. We have determined that an elimination time constant $T_e$ of approximately 70 minutes provides a satisfactory approximation to the empirical data for air breathing mixtures, although our decompression plan calculator is not limited to particular chosen time constants of uptake and elimination. The final pressure $P_t$ in the equation is determined such that $P_t$ divided by the ambient pressure $P_o$ at the surface is equal to the appropriate supersaturation ratio S, depending on the amount of time spent at the working depth, as explained above.

If the surface can be reached with only one decompression stop, the time required at that stop may be obtained from the following equation:

$$t_1 = T_e \ln\left[\frac{P_o + 0.43\, d_{sl}}{P_o(S-1) - 0.43 d_{sl}}\right] = T_e \ln\left[\frac{K + d_{sl}}{K(S-1) - d_{sl}}\right]$$

The pressure $P_o$ at the surface will be approximately 14.7 psia at sea level, wherein K=34.2 feet, and as noted above, S may be chosen equal to a desired value such as 2.0, 2.2, or 2.4 depending on the dive time.

If the pressure $P_t$ that must be reached in order to surface safely is less than the pressure $P_{s1}$ at the decompression stop calculated, it is necessary for the diver to proceed to at least one more decompression stop before surfacing. This next required decompression stop can be calculated if the time that the diver spends at the first decompression stop is known. For staged decompression, the amount of time that a diver spends at the first decompression stop is arbitrary, and may be chosen at the convenience of the diver. Alternatively, if the depth of the second decompression stop is chosen arbitrarily, the time required at the first stop may be calculated. If the amount of time that the diver spends at the first decompression stop is selected, the pressure $P_t$ of the inert gas in the diver's tissues at the end of the selected time period can be calculated, and this pressure can be divided by the supersaturation ratio to determine the pressure $P_{s2}$ at the next required decompression stop, and thus the depth of the next decompression stop. The final pressure at the first decompression stop can be utilized as the initial pressure for calculation of the next decompression stop, and the total time required to decompress at the next decompression stop can be calculated. Again, if it is not possible to reach a safe pressure at the second decompression stop, a third decompression stop must be calculated in the manner given above. It is apparent that any number of required additional decompression stops may be calculated in this manner.

The drawing shows an example of a decompression plan calculator shown generally at 10 which can be utilized to calculate a decompression schedule in accordance with the method described above. The initial diver tissue pressure $P_i$ is first found on the intial pressure—initial depth scale 11 on a base 12 of the calculator 10 having spaced numerical markings thereon representing the intial depth or initial tissue pressure of a diver. The readings on the scale 11 are given in feet below the surface at sea level, with the sea level pressure $P_o = 14.7$ psia, but it is possible to translate this to absolute pressure since each approximately 34.2 feet of depth is equivalent to one atmosphere of pressure (14.7 psia). Thus, the reading on the initial depth scale will be proportional to $P_i - P_o$ or to $d_i$ where $d_i$ is a depth equivalent to the initial pressure. The desired working depth at which the diver will be remaining for a length of time $t_w$ is then found on a working depth scale 13 having spaced numerical markings thereon representing the working depth of a dive. The initial depth readings on the scale 11 and the working depth readings on the scale 13 are then aligned by a straight line hairline **14*a* and imprinted on a pointer 14. The pointer 14 is preferably a piece of straight clear plastic which is pivotally mounted at a point intermediate the end thereof to a slider 15 which is mounted for sliding movement within a first straight channel 16** formed in the base. The slider 15 may be locked within the channel 16 by means of a locking nut 17 which, when turned, causes the slider 15 to be firmly restrained against the edges of the channel 16. The pointer 14 is rotatably connected to the slider 15, and can be locked in an angular position with respect to the slider by means of a locking nut 18. The difference between the working depth shown on the working depth scale 13 and the initial depth on the scale 11 is then read under the hairline on a difference scale 19 having spaced numerical markings thereon. Alternatively, the scales 11 and 13 may be related such that alignment of a pointed indicator 15*a* on the slider 15 with the initial depth on the scale 11, and alignment of the hairline 14*a* with the working depth on the scale 13, allows the difference to be read under the hairline. The number read on the scale 19 is proportional to the difference obtained when the working depth is subtracted from the initial depth (i.e $d_i - d_w$ or $P_i - P_o - 0.43\, d_w$).

The difference between the initial depth (or initial pressure) and the depth of the dive $d_w$, is then multiplied, in accordance with the method described above, times $e^{t_w/T_U}$, where the time $t_w$ is the time that the diver plans to spend at the working depth. The exponential of the time may be calculated by a time scale 20 which is marked off is exponentially spaced numerical marking increments, with the upper scale 20*a* of numerical markings shown in FIG. 1 representing the scale of time for the uptake of inert gas, and with the lower scale 20*b* of numerical markings representing the time scale for elimination of inert gas from the diver's tissues. For purposes of illustration, the upper time scale 20*a* is marked off using an uptake time constant of 37.5 minutes and the lower time scale 20*b* is marked off using an elimination time constant of 75 minutes. Multiplication of the difference between the initial depth and the working depth times the exponential of the time spent at the working depth is accomplished by moving the slider 15 upwardly and turning the pointer 14 to a position such that the hairline 14*a* connects the difference found on the difference scale 19 with the time found on the time scale 20. The locking nut 18 is then turned down to lock the pointer in this position and to hold the hairline also parallel to its initial position. The slider 15 is then moved down until the hairline 14*a* intersects the working depth on the scale 13, which in effect, adds the working depth $d_w$ to the product found in the step above. This result is then divided by a constant supersaturation ratio, which is taken to be 2.0 for maximum safety, with the resulting decompression stop required being read on a decompression stop scale 21 under the hairline 14*a*. The division by 2.0 is accomplished by spacing the numerical markings twice as far apart on the decompression stop scale as on the working depth scale. With a dive beginning at sea level, where $P_o = 14.7$ psia, the decompression calculator 10 provides a value for the decompression stop according to the following equation:

$$d_{sl} = 0.5 d_w + 1.163(P_i - 14.7 - 0.43 d_w) e^{t_w/T_u} - K/2$$

or $$d_{sl} = 0.5 d_w + 0.5\,(d_i - d_w) e^{t_w/T_u} - K/2$$

where $K$ is a constant equal to the depth of water equivalent to the surface absolute pressure. $K = 34.2$ feet for dives from sea level.

If the surface can be reached with one decompression stop, the time which the diver must spend at the decompression stop depth in order to safely return to the surface is determined on one of three decompression time scales 22, 23 and 24. The first decompression time scale 22 corresponds to a supersaturation ratio of approximately 2.4, the second decompression time scale 23 corresponds to a supersaturation ratio of 2.2, and the third decompression time scale 24 corresponds to a supersaturation ratio of 2.0. A straight side pointer 25 is moved parallel to its original position up or down without rotation in a second straight channel 26 formed in a base side portion 12*a*, until the side pointer 25 aligns with the decompression stop reading found on the decompression stop scale 21. The time required to decompress at that decompression stop is then read on one of the scales 22, 23 or 24 under the side pointer 25. The first decompression time scale 22 is appropriate for dives up to one-half hour at the working depth, the second scale 23 is appropriate for dives from one-half hour to one hour at the working depth, and the third scale 24 is appropriate for dives of one to two hours or more at the working depth, regardless of the depth of the dive. Although only one supersaturation ratio is used to determine the decompression stop to be utilized, the use of three discrete supersaturation ratios to determine the decompression time results in the same amount of decompression time as would be required if a less conservative supersaturation ratio than 2.0 was utilized to calculate the decompression stop.

The time markings on the time scales 22, 23, and 24 are selected to yield time values under the pointer 25 as a function of depth $d_{sl}$ according to the equation:

$$t_1 = T_e \ln\left[\frac{P_o + 0.43\, d_{sl}}{P_o(S-1) - 0.43 d_{sl}}\right] = T_e \ln\left[\frac{K + d_{sl}}{K(S-1) - d_{sl}}\right]$$

where $T_e = 70$ minutes, $P_o = 14.7$ psia, $K = 34.2$ feet for dives from sea level, and S is the appropriate supersaturation ratio.

Where a decompression schedule cannot be worked out for single stage decompression, the decompression time scales 22, 23, and 24 cannot be utilized. However, since any dive that would require more than one decompression stop would almost certainly be a long duration dive, only a single supersaturation ratio need be utilized, and we have determined that a supersaturation ratio of approximately 2.0 is adequate for virtually all such long duration dives. Thus, the first decompression stop may be determined in the manner described above and will be read off the decompression stop scale 21. The next decompression stop may be chosen according to standard tables such as those calculated by the United States Navy, or may be spaced apart in equal or unequal increments as desired, or the time spent at the first stop may be chosen arbitrarily, which allows determination of the depth of the next stop. The calculation procedure is then continued in order to calculate the time required to stay at the first stop in order to safely ascend to the next decompression stop chosen. The required pressure $P_t$ in the diver's tissues which must be obtained at the first decompression stop in order to reach the next selected decompression stop safely, is computed by multiplying the supersaturation ratio (here assumed to be equal to 2.0) times the pressure $P_{s2}$ at the second decompression stop. The time t thus required to reach this pressure $P_t$ at the first decompression stop may be calculated from the following equation:

$$t = -T_e \ln\left[\frac{2P_{s2} - P_{sl}}{P_{ei} - P_{sl}}\right]$$

where $P_{s2}$ is the pressure at the chosen second decompression stop depth $d_{s2}$.

The same procedure may be accomplished on our decompression calculator shown in the drawing. The depth of the first decompression stop $d_{sl}$ (equivalent to $P_{sl}$) is first found on the working depth 13, and the depth equivalent to the inert gas pressure $P_{ei}$ in the diver's tissues at the end of the time that the diver spends at the working depth is located on the initial pressure scale 11. This value is easily calculated since, generally, $p_{ei} = 2P_{sl}$ or $d_{ei} = 2d_{sl} + K$. Where $P_o = 14.7$ psia, $d_{ei} = 2d_{sl} + 34.2$. The slider 15 is moved downwardly and the pointer 14 is turned until the hairline 14a of the pointer connects the initial pressure reading on the scale 11 with the original decompression stop depth reading on the working depth scale 13. The difference (equivalent to $d_{ei} - d_{sl}$) is read under the hairline 14a on the difference scale 19. The depth of the next or second decompression stop is then located on the decompression stop scale 21. The slider 15 and pointer 14 are then adjusted so that the hairline 14a connects the second decompression stop reading on the scale 21 with the first decompression stop reading on the scale 13. The pointer is then locked in this position, with the inclination of the pointer in this position being proportional to the difference $2P_{s2} - P_{sl}$, or $d_{s2} - d_{sl} + K$, where $K = 34.2$ when the dive begins at sea level. The slider 15 is then moved upwardly until the hairline 14a intersects the previously determined difference reading on the difference scale 19. The reading on the lower portion of time scale 15 (corresponding to elimination of inert gas) under the hairline is located, with the intersection of the hairline and the time scale being proportional to $$\frac{d_{ei} - d_{sl}}{d_{s2} - d_{sl} + K}.$$

The reading on the time scale under the hairline gives the amount of time that the diver must remain at the first decompression stop. Because of the exponential progression of the numbering on the time scale 15, the reading obtained thereon is equal to $$t = T_e \ln\left[\frac{d_{ei} - d_{sl}}{d_{s2} - d_{sl} + K}\right] \text{or } t = T_e \ln\left[\frac{d_{sl} + K}{d_{s2} - d_{sl} + K}\right]$$

Again, $K = 34.2$ feet for a dive from sea level.

If the surface cannot be reached safely from the second decompression stop, a third decompression stop, and the time required at such stop, may be calculated as above. This procedure may be repeated as often as necessary until surfacing is achieved.

It is understood that our invention is not confined to particular embodiments herein illustrated and described, but embraces all such modified forms thereof as come within the scope of the following claims.

We claim:

1. A decompression plan calculator, comprising:

a. a working depth having numerical markings thereon representing the working depth $d_w$ of a dive;

b. an initial depth scale having numerical markings thereon representing the initial depth $d_i$ of a dive;

c. a difference scale having numerical markings thereon;

d. means for indicating on said difference scale the difference $d_i - d_w$ between a numerical value located on said working depth scale and a numerical value located on said initial depth scale;

e. a decompression stop depth scale having numerical markings thereon representing the depth $d_{sl}$ of a decompression stop;

f. an uptake time scale having numerical markings thereon representing the time $t_w$ spent at the working depth, the numerical markings on said uptake time scale being spaced thereon in proportion to $e^{t_w/T_u}$ where $T_u$ is a selected uptake time constant;

g. means for dividing a reading equal to $d_i - d_w$ on said difference scale by a value equal to $e^{t_w/T_u}$ determined on said uptake time scale, adding the working depth $d_w$ located on said working depth scale to the quotient, substracting a constant K equal to the depth of water equivalent to surface absolute pressure, and for indicating the sum $$\frac{d_w}{2} + \frac{(d_i - d_w)}{2} e^{-t_w/T_u} - \frac{K}{2}$$

on said decompression stop depth scale, whereby such sum is equal to a safe decompression stop depth $d_{sl}$;

h. at least one decompression stop time scale having numerical markings thereon representing the amount of time $t_1$ that the diver must spend at the decompression stop depth $d_{sl}$ in order to safely surface;

i. means for indicating on said decompression stop time scale a time reading $t_1$ corresponding to a decompression stop reading $d_{sl}$ on said decompression stop scale wherein $t_1$ and $d_{sl}$ are related such that the reading $t_1$ is approximately equal to $$T_e \ln\left[\frac{K + d_{s1}}{K(s-1) - d_{s1}}\right]$$

where $T_e$ is selected time constant of eimination not equal to $T_u$, and where S is a chosen supersaturation ratio.

2. The decompression plan calculator specified in claim 1 including (1) and elimination time scale having numerical markings thereon representing time $t_1$ spent at a decompression stop, the numerical markings on said elimination time scale being spaced thereon in proportion to $e^{t_1/T_e}$ where $T_e$ is the selected time constant of elimination, and (2) means for subtracting a first decompression stop reading $d_{sl}$ on said working depth scale from a second decompression stop reading $d_{s2}$ on said decompression stop scale and for intersecting said elimination time scale a distance along the length of said scale proportional to $$\frac{d_{s1} + K}{d_{s2} - d_{s1} + K}$$

to indicate a reading $t_1$ on said elimination time scale numerical markings such that $t_1$ is approximately equal to $$T_e \ln \left[ \frac{d_{s1} + K}{d_{s2} - d_{s1} + K} \right].$$

3. A decompression plan calculator, comprising:

a. a working depth scale having spaced numerical markings thereon representing the working depth $d_w$ of a dive;

b. an initial depth scale having spaced numerical markings thereon representing the initial depth $d_i$ of a dive;

c. a difference scale having numerical markings thereon with the spacing between said markings being selected such that a straight line intersecting a numerical value $d_w$ on said working depth scale and a numerical value $d_i$ on said initial depth scale will intersect said difference scale as a numerical marking value thereon proportional to $d_i - d_w$;

d. an uptake time scale having spaced numerical markings thereon representing the time $t_w$ spent at the working depth, the spacing between said markings being proportional to $e^{t_w/T_u}$ where $T_u$ is a chosen uptake time constant;

e. a decompression stop scale having spaced numerical markings thereon, the spacing between said markings being selected and the relative positions of said uptake time scale and said decompression stop scale being selected such that a first straight line intersecting said working depth $d_w$ on said working depth scale will intersect said decompression stop scale at a numerical value $d_{sl}$ equal to $$\frac{d_w}{2} + \frac{(d_i - d_w)}{2} e^{-t_w/T_u} - \frac{K}{2}$$

where K is a constant equal to the depth of water equivalent to the absolute pressure at the surface and where said first straight line is parallel to a second straight line which intersects the difference $d_i - d_w$ on said working pressure scale and the time $t_w$ spent at the working depth on said uptake time scale;

f. at least one decompression stop time scale having spaced numerical markings thereon representing the amount of time $t_1$ a diver must spend at the decompression stop depth $d_{sl}$ in order to safely surface, the spacing of said markings being selected and the relative position of said decompression stop scale and said decompression stop time scale being selected such that a line which intersects the value $d_{sl}$ on said decompression stop scale, and which is parallel to a preselected straight line on the decompression calculator, will intersect said decompression stop time scale at a numerical marking value approximately equal to $$T_e \ln \left[ \frac{K + d_{sl}}{K(s-1) - d_{sl}} \right]$$

where $T_e$ is a selected time constant of elimination not equal to $T_u$, and where S is a chosen supersaturation ratio, whereby said numerical marking value provides an amount of time required at the decompression stop depth $d_{sl}$ before safely surfacing.

4. The decompression plan calculator specified in claim 3 including an elimination time scale having spaced numerical markings thereon representing the time $t_1$ spent at a depth $d_{sl}$, the spacing between said markings being proportional to $e^{t_l/T_e}$ where $T_e$ is a chosen elimination time constant not equal to $T_u$, and wherein said elimination time scale, said working depth scale, said initial depth scale and said decompression stop scale are related such that for a first straight line intersecting a second decompression stop value $d_{s2}$ on said decompression stop scale and a first decompression stop value $d_{sl}$ on said working depth scale, a line parallel thereto which intersects said difference scale at a numerical value proportional to $d_{sl} + K$ will intersect said elimination time scale at a numerical marking value $t_1$ approximately equal to $$T_e \ln \left[ \frac{d_{sl} + K}{d_{s2} - d_{sl} + K} \right]$$

where $T_e$ is a selected time constant of elimination not equal to $T_u$, whereby the time value $t_1$ is an amount of time required at the decompression stop depth $d_{sl}$ before the diver may ascend safely to the next decompression stop depth $d_{s2}$.

5. A decompression plan calculator comprising:

a. a base having a first and second straight channel therein;

b. a slider movable within said first channel;

c. a pointer pivotally mounted to said slider, said pointer having a straight hairline thereon;

d. a straight side pointer movable in said second channel in a straight line and without rotation;

e. an initial depth scale on said base having numerical markings thereon representing the initial depth of a dive;

f. a working depth scale on said base having numerical markings thereon representing the working depth of a dive;

g. a difference scale on said base having numerical markings thereon, wherein said pointer and said initial depth, working depth, and difference scales cooperate to indicate the difference of values on said initial depth and working depth scales on said difference scale;

h. a decompression stop depth scale on said base having numerical markings thereon representing the depth of a decompression stop;

i. an uptake time scale on said base having numerical markings thereon representing the time spent at the working depth, the numerical markings on said uptake time scale being spaced thereon in proportion to the exponential of the time at working depth value divided by a chosen uptake time constant, wherein said pointer, said difference scale, said decompression stop scale and said uptake time scale cooperate to indicate a safe decompression stop depth on said decompression stop scale for selected values of initial depth, working depth, and time at working depth;

j. at least one decompression time scale on said base having numerical markings thereon representing the amount of time that a diver must spend at the decompression stop depth in order to surface safely, wherein said side pointer and said decompression stop and decompression time scales cooperate to indicate a safe decompression time on said decompression time scale for a selected decompression stop value.

6. The decompression plan calculator specified in claim 5 including an elimination time scale on said base having numerical markings thereon representing time spent at a decompression stop, the numerical markings on said elimination time scale being spaced thereon in proportion to the exponential of time at a decompression stop divided by a chosen elimination time constant, wherein said pointer and said scales cooperate to indicate on said elimination time scale a safe amount of time spent at a selected first decompression stop depth in order to safely asend to a second decompression stop depth.

* * * * *

UNITED STATES PATENT AND TRADEMARK OFFICE

CERTIFICATE OF CORRECTION

PATENT NO. : 4,037,084

DATED : July 19, 1977

INVENTOR(S) : Ali A. Seireg and Amr M.S. Baz

It is certified that error appears in the above-identified patent and that said Letters Patent are hereby corrected as shown below:

Column 5, Line 11 "drive" should be --dive--;

Column 5, Line 58 "sabstantially" should be --substantially--;

Column 10, Line 1 "a. a working depth having numerical markings" should be --a. a working depth scale having numerical markings--;

Column 10, Line 13 "$d_{s\ell}$" should be --$d_{s1}$--;

Column 10, Line 34 "$d_{s\ell}$" should be --$d_{s1}$--;

Column 10, Line 38 "$d_{s\ell}$" should be --$d_{s1}$--;

Column 10, Line 42-43 "$d_{s\ell}$" should be --$d_{s1}$--;

Column 10, Line 52 "eimination" should be --elimination--;

Column 10, Line 55 "and elimination" should be --an elimination--;

Column 10, Line 59 "$e^{t_\ell/T}e$" should be --$e^{-t_1/T}e$--;

Column 10, Line 61 "$d_{s\ell}$" should be --$d_{s1}$--;

UNITED STATES PATENT AND TRADEMARK OFFICE
CERTIFICATE OF CORRECTION

PATENT NO. : 4,037,084

DATED : July 19, 1977

INVENTOR(S) : Ali A. Seireg and Amr M.S. Baz

It is certified that error appears in the above-identified patent and that said Letters Patent are hereby corrected as shown below:

Column 11, Line 40 "$d_{s\ell}$" should be --$d_{s1}$--;

Column 11, Line 56 "$d_{s\ell}$" should be --$d_{s1}$--;

Column 11, Line 61 "$d_{s\ell}$" should be --$d_{s1}$--;

Column 12, Line 3 "$T_e \ln \left[ \frac{K + d_{s\ell}}{K(s - \ell 1) - d_{s\ell}} \right]$" should be --$T_e \ln \left[ \frac{K + d_{s1}}{K(S - 1) - d_{s1}} \right]$--;

Column 12, Line 10 "$d_{s\ell}$" should be --$d_{s1}$--;

Column 12, Line 14 "$d_{s\ell}$" should be --$d_{s1}$--;

Column 12, Line 15 "$e^{t_\ell}/T_e$" should be --$e^{t_1}/T_e$--;

Column 12, Line 22 "$d_{s\ell}$" should be --$d_{s1}$--;

Column 12, Line 24 "$d_{s\ell}$" should be --$d_{s1}$--;

UNITED STATES PATENT AND TRADEMARK OFFICE

CERTIFICATE OF CORRECTION

PATENT NO. : 4,037,084

DATED : July 19, 1977

INVENTOR(S) : Ali A. Seireg and Amr M.S. Baz

It is certified that error appears in the above-identified patent and that said Letters Patent are hereby corrected as shown below:

Column 12, Line 30 "$T_e \left[ \frac{d_{s\ell} + K}{d_{s2} - d_{s\ell} + K} \right]$" should be --- $T_e \ln \left[ \frac{d_{s1} + K}{d_{s2} - d_{s1} + K} \right]$ --;

Column 12, Line 35 "$d_{s\ell}$" should be --$d_{s1}$--

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*